US008408037B2

(12) United States Patent
Lamb et al.

(10) Patent No.: US 8,408,037 B2
(45) Date of Patent: Apr. 2, 2013

(54) PIERCE NUT MANUFACTURING METHOD AND APPARATUS

(75) Inventors: William Lamb, Saline, CA (US); Andrew Rowbotham, Charlevoix, MI (US); Kim Crampton, Manchester, MI (US); Michael Behm, New Boston, MI (US); Ron Hall, Cookeville, TN (US)

(73) Assignee: Fastner Advance Products, Manchester, MI (US)

( * ) Notice: Subject to any disclaimer, the term of this patent is extended or adjusted under 35 U.S.C. 154(b) by 0 days.

(21) Appl. No.: 13/530,281

(22) Filed: Jun. 22, 2012

(65) Prior Publication Data

US 2012/0264529 A1 Oct. 18, 2012

Related U.S. Application Data

(63) Continuation of application No. 12/496,745, filed on Jul. 2, 2009, now abandoned.

(51) Int. Cl.

| | |
|---|---|
| ***B21D 53/24*** | (2006.01) |
| ***B21D 26/06*** | (2006.01) |
| ***B21D 17/00*** | (2006.01) |

(52) U.S. Cl. ..... 72/333; 72/334; 72/377; 72/464; 29/412; 29/417; 29/509; 470/25; 470/26; 470/91; 470/96; 470/109

(58) Field of Classification Search ..... 72/333, 72/334, 336, 377, 464, 474; 29/412, 417, 29/432.2, 509; 470/25, 26, 91, 95, 96, 109
See application file for complete search history.

(56) References Cited

U.S. PATENT DOCUMENTS

| | | | | |
|---|---|---|---|---|
| 3,582,225 | A | 6/1971 | Hanzel | |
| 3,704,507 | A * | 12/1972 | Grube | 29/417 |
| 3,711,931 | A | 1/1973 | Ladouceur et al. | |
| 3,748,674 | A | 7/1973 | Powell et al. | |
| 4,299,000 | A * | 11/1981 | Koch | 470/25 |
| 4,971,499 | A | 11/1990 | Ladouceur | |
| 5,016,461 | A | 5/1991 | Walker et al. | |
| 5,140,735 | A | 8/1992 | Ladouceur | |
| 5,348,429 | A | 9/1994 | Pfister | |
| 5,383,021 | A | 1/1995 | Hanna | |
| 5,618,237 | A * | 4/1997 | Shinjo | 470/91 |
| 6,122,816 | A | 9/2000 | Ladouceur | |
| 6,578,258 | B1 | 6/2003 | Boyer et al. | |
| 6,631,827 | B2 | 10/2003 | Goodsmith et al. | |
| 6,647,608 | B2 | 11/2003 | Wojciechowski et al. | |
| 6,912,776 | B2 | 7/2005 | Vrana | |
| 6,925,698 | B2 | 8/2005 | Goodsmith et al. | |
| 6,957,483 | B2 | 10/2005 | Woods | |
| 6,993,831 | B2 | 2/2006 | Vrana | |
| 7,013,550 | B2 * | 3/2006 | Shinjo | 29/558 |
| 7,047,617 | B2 | 5/2006 | Ladouceur | |

(Continued)

*Primary Examiner* — David B Jones
(74) *Attorney, Agent, or Firm* — The Dobrusin Law Firm, P.C.

(57) ABSTRACT

The present invention is premised upon method of manufacturing rolled pierce nuts having a predetermined profile from a metal rod, more particularly to a method and apparatus delivering greater manufacturing flexibility through the use of multiple stations with flexible inputs and outputs.

16 Claims, 1 Drawing Sheet

U.S. PATENT DOCUMENTS

| | | | |
|---|---|---|---|
| 7,124,492 | B2 | 10/2006 | Wojciechowski et al. |
| 7,152,294 | B2 | 12/2006 | Ladouceur |
| 7,165,312 | B2 | 1/2007 | Vrana et al. |
| 7,179,034 | B2 | 2/2007 | Ladouceur |
| 7,269,893 | B2 | 9/2007 | Ericsson |
| 7,367,893 | B2 | 5/2008 | Vrana et al. |
| 7,380,326 | B2 | 6/2008 | Kovac |
| 7,398,896 | B2 | 7/2008 | Morgan |
| 2006/0026813 | A1 | 2/2006 | Whitaker |
| 2008/0124185 | A1 | 5/2008 | Kovac |

* cited by examiner

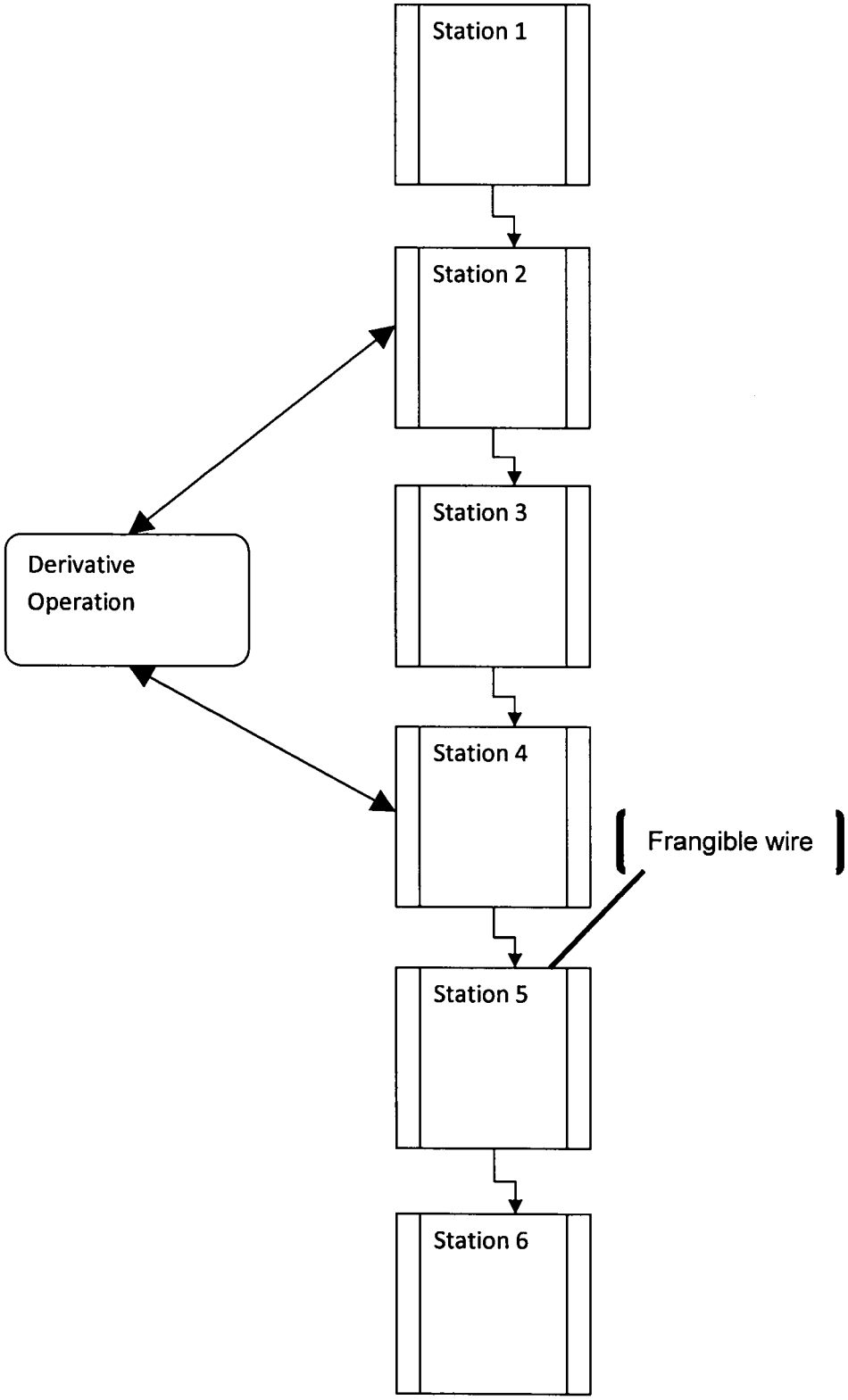
Station 1
Station 2
Station 3
Station 4
Station 5
Station 6
Derivative Operation
Frangible wire

PIERCE NUT MANUFACTURING METHOD AND APPARATUS

CLAIM OF PRIORITY

This application is a continuation of and claims priority from application Ser. No. 12/496,745 filed Jul. 2, 2009, incorporated herein by reference.

FIELD OF THE INVENTION

The present invention relates to an improved pierce nut manufacturing method and apparatus, more particularly to a method and apparatus delivering greater manufacturing flexibility.

BACKGROUND

Generally, pierce nuts have been used in industry for many decades and the improvements to the manufacturing processes of these nuts has been and continues to be, an area of great interest/effort. The present invention is the culmination of one such effort. It is believed that most, if not all, the focus in improving the manufacturing processes has been centered around the issue of increasing through-put and detection of quality defects. One such example may be found in U.S. Pat. No. 7,367,893, where a two-out die is used, incorporated herein by reference. It is believed that the area of manufacturing process flexibility has been largely ignored in the quest for higher production rates and lower rejection rates. It is also believed that manufacturing process flexibility can provide a manufacturer an advantage over those processes solely focused on speed and/or through-put. It is apparent that there is an unmet market need for a manufacturer to offer pierce nuts that can have differing characteristics and/or properties while still maintaining a high level of quality and a relatively low cost. The present invention seeks to address this unmet market need through its inventive process/method.

Among the other literature that may pertain to this technology include the following patent documents: U.S. Pat. No. 5,383,021; U.S. Pat. No. 5,348,429; U.S. Pat. No. 5,016,461; U.S. Pat. No. 4,971,499; U.S. Pat. No. 3,748,674; and U.S. Pat. No. 3,711,931, all incorporated herein by reference for all purposes.

SUMMARY OF THE INVENTION

The present invention is directed to one such solution, and particularly is directed to addressing the unmet market need discussed above. It is believed that the inventive process disclosed has the advantage of being able to produce pierce nuts with differing characteristics and/or properties form a single main production line.

Accordingly, pursuant to a first aspect of the present invention, there is contemplated a method of manufacturing rolled pierce nuts having a predetermined profile from a metal rod including the steps of: a. providing a articulating die including a punching station for punching a through-hole in the rod, a counter-sinking station for counter-sinking a least a portion of the through hole and a final trim station for cutting a blank nut to length; b. advancing the rod through the punching station and punching the through-hole; c. advancing the rod through the counter-sinking station and creating the counter-sunk portion of the through-hole; d. advancing the rod through the final trim station and cutting the blank nut to length; e. providing a hole sensor disposed after the final trim station for detecting the presence of the through-hole; f. providing a first hopper to collect blank nuts; g. advancing the blank nut past the hole sensor; h. removing the blank nut if a non-compliant hole is detected; i. advancing the blank nut into the first hopper if a compliant hole is detected; j. providing a tapper station for tapping the through-hole of the blank nut; k. advancing the blank nut from the first hopper to the tapper station; l. tapping a thread into the through-hole creating a tapped nut; m. providing a thread sensor after the tapper station for detecting the presence of the thread in the tapped nut; n. providing a second hopper to collect tapped nuts; o. advancing the tapped nut past the thread sensor; p. removing the tapped nut if a non-compliant thread is detected; q. advancing the tapped nut into the second hopper if a compliant thread is detected; r. providing at least one frangible wire; s. providing a cinching tool station to cinch the at least one frangible wire to the tapped nut creating a cinched pierce nut; t. providing a spooling station; u. advancing the tapped nut and the at least one frangible wire to the cinching tool station; v. cinching the tapped nut to the at least one frangible wire; w. advancing the cinched pierce nut to the spooling station; and x. spooling the cinched pierce nut, thus creating the rolled pierce nuts.

The first aspect of the present invention may be further characterized by one or any combination of the features described herein, such as including the step of removing the blank nuts from the first hopper to perform at least one first derivative operation on the blank nuts; including the step of performing at least one first derivative operation on the blank nut, thus creating a modified bank nut; including the step of returning the modified blank nut to the first hopper, the second hopper or both; the at least one first derivative operation is selected from the group consisting of plating, drilling, painting, inspecting, heat treating; annealing; and de-burring; including the step of removing the tapped nuts from the first hopper to perform at least one second derivative operation on the tapped nuts; including the step of performing at least one second derivative operation on the blank nut, thus creating a modified tapped nut; including the step of returning the modified tapped nut to the first hopper, the second hopper or both; the at least one second derivative operation is selected from the group consisting of plating, drilling, painting, inspecting, heat treating; annealing; and de-burring.

DESCRIPTION OF THE DRAWINGS

FIG. 1 is an exemplary flow diagram according to teachings of the present invention.

DETAILED DESCRIPTION OF THE PREFERRED EMBODIMENT

The invention is an improved pierce nut manufacturing method and apparatus, more particularly to a method and apparatus delivering greater manufacturing flexibility. As further described below, the method and apparatus may utilize an number of "hoppers" along the processing line to function as places where the pierce nuts can be added and/or removed from the line, thus allowing derivative operation(s) to be conducted to the pierce nuts or to have "finished" nuts that do not require all the steps of the overall processing line (e.g. nuts without threads, nuts not placed on a frangible wire, etc.). It is contemplated that the processing line may be described as including a number of stations, where each station performs at least one operation in the manufacture of the pierce nut.

In a first station, a metal rod with a predetermined profile may be provided. For example, a rod that is supplied as a coiled roll. The first station may also include providing an articulating die set in a reciprocating press. The die set may include a punching station for punching a through-hole in the rod, a counter-sinking station for counter-sinking a least a portion of the through hole and a final trim station for cutting a blank nut to length. In a preferred embodiment, the articulating die set is a "one-out" die that produces single nuts, although it is contemplated that a "multiple-out die" may be possible. The process through the first station may include advancing the rod through the punching station and punching the through-hole; advancing the rod through the counter-sinking station and creating the counter-sunk portion of the through-hole; and advancing the rod through the final trim station thus cutting the blank nut to length.

In a preferred embodiment, the first station also includes providing a hole sensor disposed after the final trim station for detecting the presence of the through-hole, although this could also be located separately from the first station. The process may continue with advancing the blank nut past the hole sensor; removing the blank nut if a non-compliant hole is detected; advancing the blank nut into a first hopper (second station) if a compliant hole is detected. It is contemplated that the hole sensor may be a vision system that can detect the presence of the hole and provide feedback to a actuator that can remove a blank nut that does not have the required hole.

In a second station, the blank nuts that make it past the hole sensor, may be collected. This second station may serve as a loading and/or unloading point in the processing line for blank nuts. It is contemplated that the blank nuts may represent the finished product and unloaded at the second station as such. The blank nuts may be unloaded at this point to conduct derivative operations, such as, but not limited to: plating, drilling, painting, inspecting, heat treating; annealing; de-burring, and storing. After any derivative operation takes place, the second station may be used to introduce the "modified" blank nut back into the processing line. The second station may be referred to a first "hopper" wherein a hopper is commonly defined as a tapering container that discharges its contents at the bottom, but should not be limited as such so long as its function is to provide as a loading and/or unloading point in the processing line for the blank nuts.

A third station may be provided in the processing line, where the third station may include a tapper station for tapping the through-hole of the blank nut and a thread sensor after the tapper station for detecting the presence of the thread. The process may include advancing the blank nut from the first hopper to the tapper station; tapping a thread into the through-hole creating a tapped nut; advancing the tapped nut past the thread sensor; removing the tapped nut if a non-compliant thread is detected; and advancing the tapped nut into a second hopper (fourth station) if a compliant thread is detected. It is contemplated that the thread sensor may act in a fashion similarly to the hole sensor. The tapper station, in a preferred embodiment may be a simple machine that functions such as the machine taught in U.S. Pat. No. 3,582,225.

In a fourth station, the threaded nuts that make it past the hole sensor, may be collected. This fourth station may serve as a loading and/or unloading point in the processing line for threaded nuts. It also may serve as a loading point for other nuts (e.g. blank nuts, "modified" blank nuts, and/or "modified" threaded nuts) that may require the processing of the subsequent stations described below. It is contemplated that the threaded nuts may represent the finished product and unloaded at the fourth station as such. The threaded nuts may be unloaded at this point to conduct derivative operations, such as, but not limited to: plating, drilling, painting, inspecting, heat treating; annealing; de-burring, and storing. After any derivative operation takes place, the fourth station may be used to introduce the threaded nuts back into the processing line. The fourth station may be referred to a second "hopper" wherein a hopper is commonly defined as a tapering container that discharges its contents at the bottom, but should not be limited as such so long as its function is to provide as a loading and/or unloading point in the processing line for the nuts.

A fifth station, with nuts being fed from the fourth station, may include a cinching tool station. At least one frangible wire is also being fed into the fifth station (preferably from a coiled roll of wire). The cinching tool station may bring the nut and the frangible wire together creating a cinched pierce nut (the nut preferably being blank nuts, "modified" blank nuts, threaded nuts, and/or "modified" threaded nuts).

A sixth station (spooling station) may take the cinched nut from the fifth station and spool it onto a roll thus making the final product.

Of note, it is contemplated that any of the stations described above may include multiple components (e.g. two or more "hoppers, two or more "tapper stations", two or more "articulating dies") and feeds to and from the previous stations may be split between the multiple components.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

Any numerical values recited in the above application include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes.

The term "consisting essentially of" to describe a combination shall include the elements, ingredients, components or steps identified, and such other elements ingredients, components or steps that do not materially affect the basic and novel characteristics of the combination.

The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

What is claimed is:

1. A method of manufacturing rolled pierce nuts having a predetermined profile from a metal rod comprising the steps of:

a. punching a plurality of through-holes in the rod;
b. cutting the rod to form a plurality of blank nuts having through-holes using a one out die;
c. collecting the blank nuts;
d. tapping a thread into the through-holes of the blank nuts creating tapped nuts;
e. collecting the tapped nuts;
f. cinching the tapped nuts to at least one frangible wire to form a plurality of cinched pierce nuts connected by the at least on frangible wire.

2. The method according to claim 1, further including performing at least one first derivative operation on the blank nut, thus creating a modified bank nut.

3. The method according to claim 2, further including the step of returning the modified blank nut to the process.

4. The method of claim 2 wherein the at least one first derivative operation is selected from the group consisting of plating, drilling, painting, inspecting, heat treating; annealing; and de-burring.

5. The method according to claim 1, further including the step of performing at least one second derivative operation on the blank nut, thus creating a modified tapped nut.

6. The method according to claim 5, further including the step of returning the modified tapped nut to the process.

7. The method of claim 5 wherein the at least one second derivative operation is selected from the group consisting of plating, drilling, painting, inspecting, heat treating; annealing; and de-burring.

8. The method of claim 1 further comprising spooling the cinched pierce nuts.

9. A method of manufacturing rolled pierce nuts having a predetermined profile from a metal rod comprising the steps of:

a. punching a plurality of through-holes in the rod;
b. creating a counter-sunk portion of the through-hole
c. cutting the rod to form a plurality of blank nuts having through-holes using a one out die;
d. collecting the blank nuts;
e. tapping a thread into the through-holes of the blank nuts creating tapped nuts;
f. collecting the tapped nuts;
g. cinching the tapped nuts to at least one frangible wire to form a plurality of cinched pierce nuts connected by the at least on frangible wire.

10. The method according to claim 9, further including performing at least one first derivative operation on the blank nut, thus creating a modified bank nut.

11. The method according to claim 10, further including the step of returning the modified blank nut to the process.

12. The method of claim 10 wherein the at least one first derivative operation is selected from the group consisting of plating, drilling, painting, inspecting, heat treating; annealing; and de-burring.

13. The method according to claim 9, further including the step of performing at least one second derivative operation on the blank nut, thus creating a modified tapped nut.

14. The method according to claim 9, further including the step of returning the modified tapped nut to the process.

15. The method of claim 14 wherein the at least one second derivative operation is selected from the group consisting of plating, drilling, painting, inspecting, heat treating; annealing; and de-burring.

16. The method of claim 9 further comprising spooling the cinched pierce nuts.

* * * * *

UNITED STATES PATENT AND TRADEMARK OFFICE

CERTIFICATE OF CORRECTION

PATENT NO. : 8,408,037 B2
APPLICATION NO. : 13/530281
DATED : April 2, 2013
INVENTOR(S) : William Lamb It is certified that error appears in the above-identified patent and that said Letters Patent is hereby corrected as shown below:

In the Claims:

Column 5, Claim 2, line 40, “bank” should be “blank”

Column 6, Claim 10, line 28, “bank” should be “blank”

Signed and Sealed this
Eleventh Day of June, 2013

Teresa Stanek Rea
*Acting Director of the United States Patent and Trademark Office*